United States Patent [19]

Jensen et al.

[11] Patent Number: 4,932,333

[45] Date of Patent: Jun. 12, 1990

[54] STABILIZING WHEELS FOR FOLDING TABLE

[75] Inventors: Douglas R. Jensen; Richard C. Bue, both of Chaska, Minn.

[73] Assignee: Sico Incorporated, Minneapolis, Minn.

[21] Appl. No.: 379,911

[22] Filed: Jul. 14, 1989

[51] Int. Cl.[5] ..... A47B 3/00

[52] U.S. Cl. ..... 108/113; 248/188.8; 248/688; 297/159

[58] Field of Search ..... 297/157, 159, 310, 195; 108/113, 112, 114; 248/188.7, 188.8, 688

[56] References Cited

U.S. PATENT DOCUMENTS

| | | | |
|---|---|---|---|
| Re. 24,454 | 4/1958 | Wilson . | |
| 2,645,539 | 7/1953 | Thompson . | |
| 2,721,778 | 10/1955 | Wilson . | |
| 2,730,417 | 1/1956 | Mitchell . | |
| 2,739,860 | 3/1956 | Wilson . | |
| 2,766,089 | 10/1956 | Nielsen | 108/113 |
| 2,771,937 | 11/1956 | Wilson . | |
| 2,777,742 | 1/1957 | Schieber | 108/113 |
| 2,831,741 | 4/1958 | Wilson . | |
| 2,873,157 | 2/1959 | Wilson . | |
| 2,977,169 | 3/1961 | Geller . | |
| 2,978,754 | 4/1961 | Wilson . | |
| 2,983,968 | 5/1961 | Wurn . | |
| 2,993,740 | 7/1961 | Good . | |
| 3,027,209 | 3/1962 | Nielsen . | |
| 3,028,197 | 4/1962 | Wilson . | |
| 3,075,809 | 1/1963 | Wilson . | |
| 3,080,333 | 3/1963 | Risdall . | |
| 3,099,480 | 7/1963 | Wilson . | |
| 3,143,982 | 8/1964 | Blink et al. . | |
| 3,245,363 | 4/1966 | Amthor, Jr. et al. . | |
| 3,276,401 | 10/1966 | Wilson et al. . | |
| 3,337,262 | 8/1967 | Katzfey et al. . | |
| 3,351,029 | 11/1967 | Bue . | |
| 3,371,959 | 3/1968 | Gordin | 297/310 |
| 3,557,720 | 1/1971 | Blink et al. . | |
| 3,799,073 | 3/1974 | Nielsen . | |
| 3,999,491 | 12/1976 | Wilson . | |
| 4,040,658 | 8/1977 | Mayol | 297/159 |
| 4,053,129 | 10/1977 | Graff | 248/188.7 |
| 4,054,096 | 10/1977 | Wilson et al. . | |
| 4,133,271 | 1/1979 | Carlson . | |
| 4,183,579 | 1/1980 | Gonzalez et al. | 297/195 |
| 4,327,650 | 5/1982 | Bue . | |
| 4,819,569 | 4/1989 | Bastian et al. | 108/113 |
| 4,852,836 | 8/1989 | Kawazoe | 248/168 |

FOREIGN PATENT DOCUMENTS

| | | |
|---|---|---|
| 517072 | 10/1955 | Canada . |

*Primary Examiner*—Peter A. Aschenbrenner
*Attorney, Agent, or Firm*—Merchant, Gould, Smith, Edell, Welter & Schmidt

[57] ABSTRACT

A folding table (10) has two folding tabletops (12) and associated benches (14) which fold on a linkage (38). The support legs (18) have main support wheels (26) and stabilizing wheels (3) mounted on an outrigger (32) extending outward from the main support wheel riser (28) providing additional stability. The outrigger (32) has a riser and a slanted section extending up from the riser to the main support wheel riser (28).

8 Claims, 2 Drawing Sheets

STABILIZING WHEELS FOR FOLDING TABLE

BACKGROUND OF THE INVENTION

The present invention relates generally to table structures and more particularly to tables which may be folded for storage and the like and which have stabilizing wheels to prevent tipping.

Folding tables are generally known in the art. Two such tables are disclosed in U.S. Pat. Nos. 2,721,778 and 2,771,937 to Wilson.

Tables of this type are generally adapted to be set up at banquet halls, lunchrooms, ballrooms and the like, and are designed to accommodate large numbers of people seated thereabout. Where space is at a premium and it is desired that a single room be utilized for seating purposes, after which it is desired that the room be cleared for dancing or other purposes, it is important that the tables be removed from the room at maximum speed and with a minimum of effort and disturbance.

To facilitate easy removal of the tables, wheels are placed on the legs so that the tables may be easily rolled into and out of position. However, when in a folded storage position, the center of gravity of the tables is relatively high, so that stability of the tables is reduced. The prior art folding tables have heretofore provided only a minimum of stability when in a storage position.

Since folding tables are used in facilities where space is at a premium, it is also important that the tables store close together and that they "nest" up against one another. Prior folding tables have support legs that impinge on one another when the table is folded, thereby preventing nesting of the tables in a tight formation if adequate stability is to be provided. In addition to the storage area required, the prior art folding tables require a large volume for shipping if adequate stabilizing legs are provided.

It is evident that a folding table is required that provides adequate stability, yet takes up a minimum of storage and shipping space. The present invention solves these and other problems associated with folding tables.

SUMMARY OF THE INVENTION

The present invention relates to a folding table and particularly to stabilizing wheels for folding tables. A center folding table folds from an in-use position to a storage position wherein the tabletops are in a substantially vertical position and the bottoms of the tabletops are opposing one another. The table also includes benches for seating along sides of the table. The benches swing upward on the upper surface of the tabletops and fold out of the way to occupy less space.

A folding linkage guides the table from the in-use position to the storage position while maintaining the legs of the table in a position substantially perpendicular to the floor. Wheels on the support structure maintain contact with the floor and provide stability when the table is in the in-use position, during folding, and when in the folded storage position. The linkage also includes safety latches for maintaining the table in the folded position.

Center legs mounted on the folding linkage extend downward from below the center hinge and provide support when in the in-use position. The center legs fold up with the tabletops in the storage position.

Supports for the table include wheels and extend downward and outward to provide stability when in the folded position and when in the in-use position. However, when in the folded position, tipping becomes a concern as the folded table tends to have a relatively high center of gravity. The present invention therefore includes an additional stabilizing wheel on an outrigger extending from each main support wheel. The stabilizing wheel extends further outward than the main support wheel, providing additional stabilizing support. The support wheels extend perpendicular from the center folding line of the table so that the tables may be nested when in the folded position and therefore take up less storage space. The outrigger has a riser extending vertically from the stabilizing wheel to a point above the lower edge of a tabletop in a folded position, so that the edges of the table are not nicked by impacting a slanted outrigger surface. As an additional safety precaution, the outrigger slants upward at an obtuse angle from the outrigger riser portion to the riser of a main support wheel so that persons are unable to stand on the outrigger and therefore cannot tip the table when in the folded storage position. It can also be appreciated that with the folding mechanism, it is important that the wheels provide a stable base during folding as well as in the folded position and in the in-use position. Therefore, the linkage maintains the legs in a perpendicular position such that both the main support wheels and the stabilizing wheels are touching the floor at all times and providing a solid support base.

Additionally, the outriggers for mounting the stabilizing wheels are rotatably mounted for shipping so that a smaller box or crate is required for the table when in the folded position. However, for safety reasons, after the table is removed from the storage container and is ready for use, the outriggers are locked into an in-use position by inserting a pin or bolt which locks the outrigger portion.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings wherein like reference numerals and letters indicate corresponding elements throughout the several views.

DETAILED DESCRIPTION OF THE PREFERRED EMBODIMENT(S)

Figure 1:
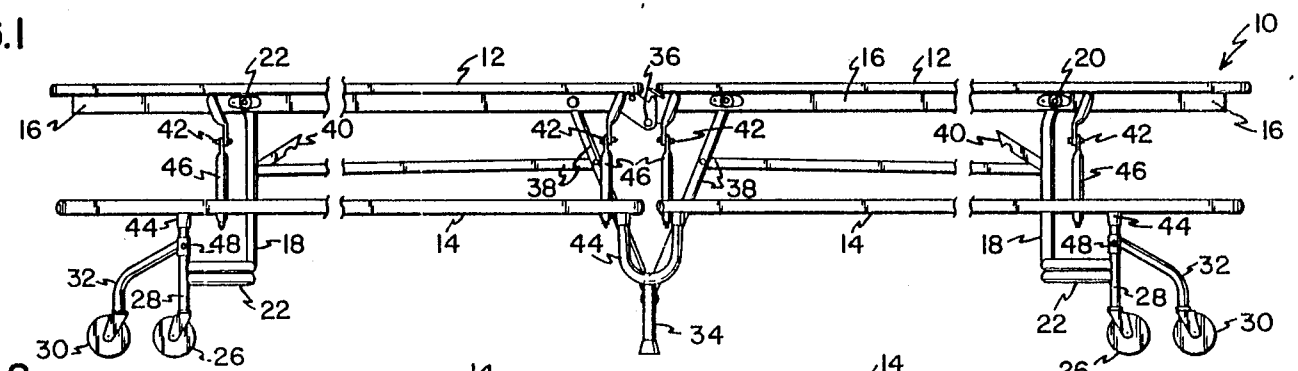
FIG. 1 is a side view of a preferred embodiment of a folding table in an unfolded in-use position having stabilizing wheels according to the principles of the present invention.

A folding table generally designated 10 is shown in FIG. 1. Folding table 10 folds along a center axis at a center hinge 36. The table 10 folds in two sections along the center hinge 36 on a folding linkage 38.

Figure 2:
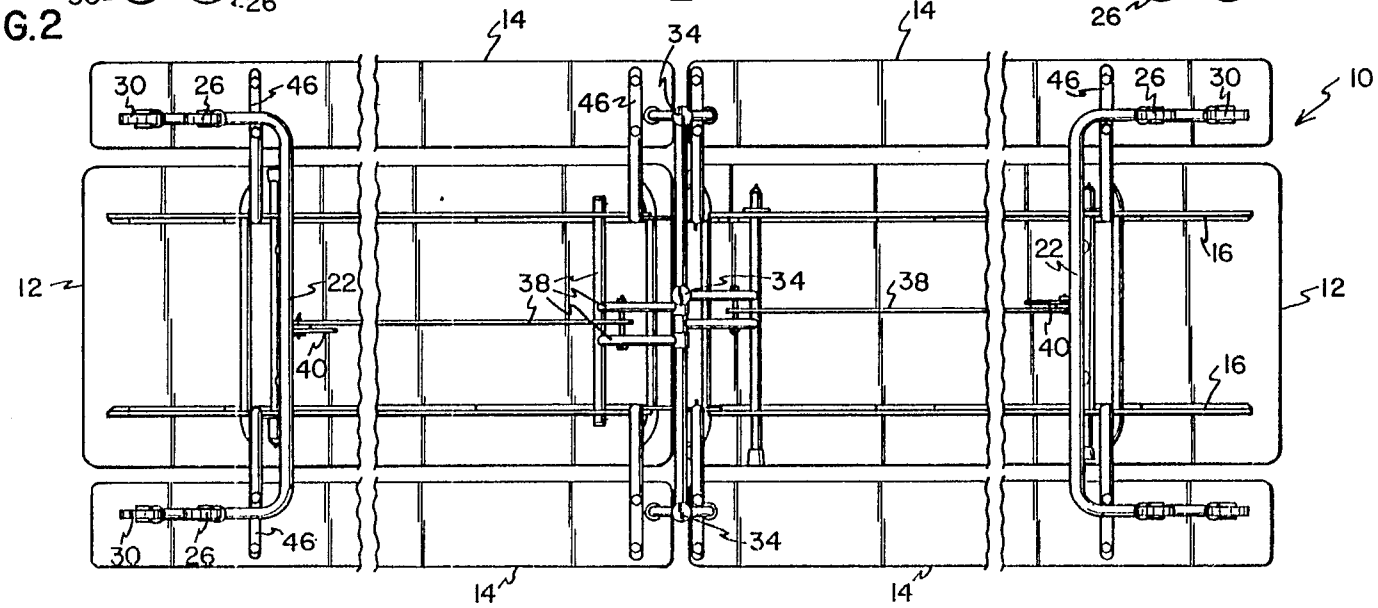
FIG. 2 is a bottom view of the folding table shown in FIG. 1 in an unfolded in-use position.
Figure 3:
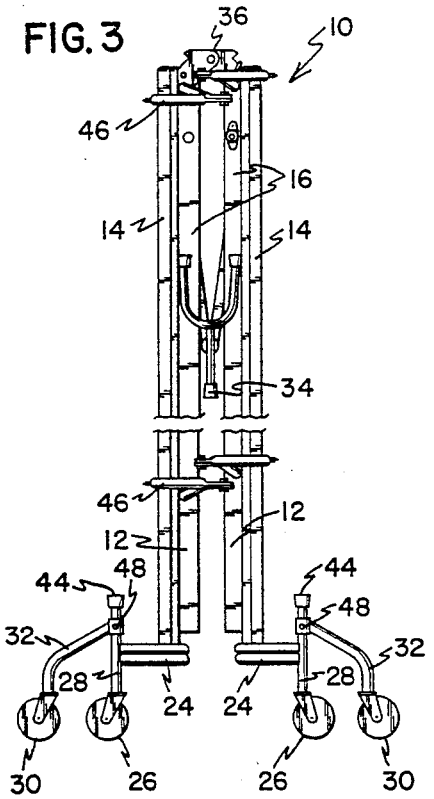
FIG. 3 is view of the folding table shown in FIG. 1 in a folded position.

Folding of the table 10 is easily accomplished by lifting upward at a center portion of the table 10 along the center hinge 36. Folding linkage 38 attaches to center legs 34 and legs 18 for folding from the in-use position to the storage position. However, it can be appreciated that any linkage which folds the table from an in-use position to a storage position while maintaining the legs in a vertical position may be used. The three center legs 34 shown in FIG. 2 provide additional support in the in-use position, but fold upward with the center hinge 38 between the tabletops 12 to a storage position as shown in FIG. 3. The folding linkage 38 folds the tabletops 12 and the center legs 34 while maintaining the support wheels 26 and stabilizing wheels 30 in contact with the floor, thereby providing additional stability during folding. When in the folded position, safety catch 40 is latched so that the table 10 cannot be accidentally unfolded.

As shown in FIG. 1., tabletops 12 have associated benches 14 for seating people at the table 10. The height of the benches 14 and tabletops 12 may be varied depending on the use, for example in lunchrooms for children, the tables and benches will be lower. In an alternate embodiment, the benches may be replaced with a row of stools (not shown). The length of the tabletops 12 and associated benches 14 may also be varied for seating of 8, 10 or 12 persons. The benches 14 fold from an in-use position as shown in FIG. 1 to a storage position as shown in FIG. 3 wherein the benches 14 fold up against the top portion of the tabletops 12.

Figure 4:
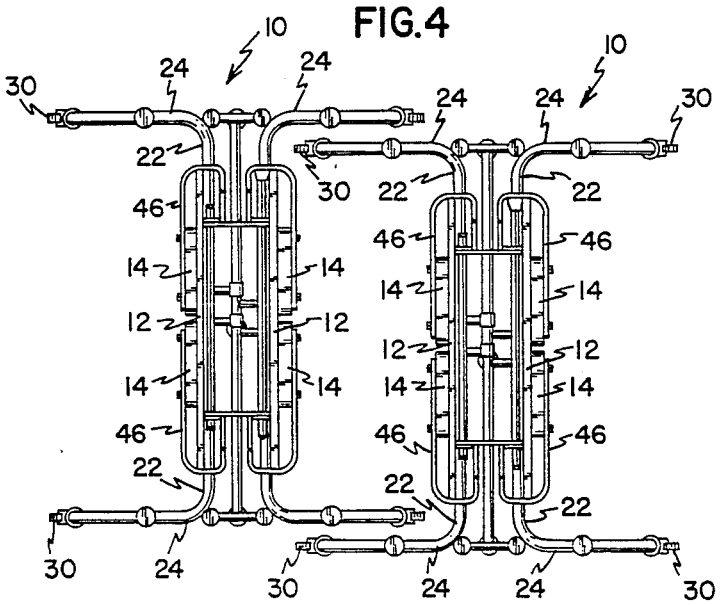
FIG. 4 is a top view of two folding tables in a folded position as shown in FIG. 3 and nested for storage; and, FIG. 5 is a bottom view of a close-up of a stabilizing wheel for the folding table according to the principles of the present invention.

As shown in FIG. 4, the benches 14 fold upward onto the tabletops 12, requiring less storage space. As shown in FIGS. 1 and 2, the benches 14 are attached to bench support arms 46 and rest on bench supports 44. The bench support arms 46 are mounted on bench hinges 42 to tabletop frame 16 and fold over onto the tabletops 12.

As shown in FIG. 1, each tabletop 12 is supported by legs 18 mounted near the outer ends of the tabletops 12. The legs 18 pivot at a point 20 on the tabletop frame 16 so that the legs remain in a substantially vertical support position while the tabletops 12 are folded. Each leg 18 includes risers 19 extending upward from cross members 22 to pivot point 20. The cross member 22 includes wheel extension 24 extending perpendicularly from the cross member 22. Main support wheels 26 attach to a main support wheel risers 28 attaching to an end of the wheel extensions 24. In addition to the main support wheel 26, a stabilizing wheel 30 mounted to an outrigger 32 attaches to the main support wheel riser 28. Each stabilizing wheel 30 maintains contact with the floor in the use position as shown in FIG. 1 and during folding into the storage position as shown in FIG. 3. The outrigger 32 includes a riser extending upward from the outrigger wheel to a point above the lowermost portion of a tabletop 12 when the table is in a folded position. The riser of the outrigger 32 lends to a lowermost end of a slanting upward section attaching to the main support wheel riser 28. The slanted section extends up from the riser portion at an obtuse angle which prevents persons from standing on the outrigger 32, thereby preventing tipping of the table 10. In the preferred embodiment, the outrigger 32 extends out from the main support wheel 26 so that the table 10 will not tip when a force equivalent to 20% of the weight of the table is applied at a height 60 inches from the floor, and so that the table 10 will not tip when it is on an incline of 10 degrees.

As shown in FIG. 4, it is also important that the tables store in a very small space when in a folded position. This is accomplished by having legs 18 that nest with one another. The outriggers 32 extend perpendicularly from the cross member 22 so that the outriggers 32 do not impinge against one another when being stored, so that the tables 10 may be stored closer together.

Figure 5:
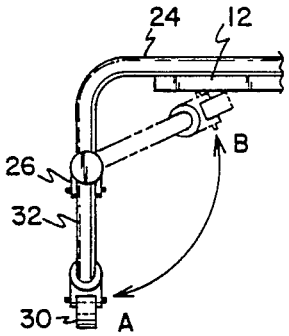

As shown in FIG. 5, the outrigger 32 pivots about the main support riser 28. The outrigger 32 folds inward from the use position A to a shipping position B. In this manner, the table 10 requires a smaller box or crate during shipping. When the table is unpacked, the outrigger 32 is folded outward to the use position as shown at A. A locking pin or bolt 48 is inserted, as shown in FIG. 1. The outrigger 32 is then locked in the use position so that the table 10 has adequate stability.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A folding table folding from an in-use position wherein two adjacent tabletop sections are horizontal to a storage position wherein the tabletops are in an opposed substantially vertical position, comprising:

two folding tabletops;

a tabletop supporting structure having center legs and tabletop end legs;

a linkage for folding the tabletops and support structure from the in-use position to the storage position; and wheels attaching at the lower portion of the end legs, wherein the wheels have a first set of main support wheels and an outrigger extending outwardly from each main support wheel, the outrigger having a stabilizing wheel extending downward an equal distance as the main support wheels, a riser portion attaching to each stabilizing wheel and extending substantially vertical from the stabilizing wheel to a position above a lower edge of a tabletop when the tabletop is in a folded position, the riser portion slanting upward from the position above the lower edge of a folded tabletop and attaching at a support structure riser extending upward from the associated main support wheel, the outrigger extending substantially along the longitudinal axis of the table.

2. A folding table according to claim 1, further comprising benches suitable for seating along the sides of the table.

3. A folding table according to claim 1, wherein the outrigger rotates from a shipping position, wherein the outrigger does not extend outward to a use position wherein the outrigger extends outward parallel to the longitudinal axis of the folding table.

4. A folding table according to claim 3, wherein the outrigger is lockable in the in-use position.

5. A center-folding table support structure, comprising:

support legs for each of two folding tabletops;

a cross member attaching at the lower end of the support legs extending substantially parallel to a center folding axis of the folding table, the cross member having end sections turned outward from the center axis of the folding table at a substantially right angle to the cross member;

main support wheels extending downward from each end section; and a stabilizing wheel mounted on an outrigger extending outward from the end section, the outrigger having a first portion attached at an upper portion of the cross member end section, the outrigger first portion angling downward to a point above a lower edge of a tabletop when in the folded position, the outrigger having a vertical riser extending downward from a lower end of the outrigger first portion to the stabilizing wheel, the stabilizing wheel extending downward to a distance even with the main support wheel.

6. An apparatus according to claim 5, wherein the main support wheel and the stabilizing wheel are freely rotatable.

7. An apparatus according to claim 5, wherein the outrigger rotates from a first shipping position to a second use position, and wherein the outrigger is lockable in the in-use position.

8. An apparatus according to claim 5, wherein the stabilizing wheel extends at a distance sufficient to maintain the table at an upright position when a horizontal force equivalent to 20% of the weight of the table is applied at a position 60 inches above the floor, and the stabilizing wheel extends a distance sufficient to prevent tipping of the table when in a folded position and placed on a sloped surface having an angle of 10 degrees with the horizontal plane.

* * * * *

UNITED STATES PATENT AND TRADEMARK OFFICE

CERTIFICATE OF CORRECTION

PATENT NO. : 4,932,333

DATED : June 12, 1990

INVENTOR(S) : Douglas R. Jensen; Richard C. Bue

It is certified that error appears in the above-identified patent and that said Letters Patent is hereby corrected as shown below:

Column 2, Line 62

Insert --a side-- after "Fig. 3 is"

Column 2, Line 63

Insert --storage-- after "folded"

Signed and Sealed this

Tenth Day of March, 1992

*Attest:*

HARRY F. MANBECK, JR.

*Attesting Officer*

*Commissioner of Patents and Trademarks*